US009228599B2

(12) United States Patent
Son et al.

(10) Patent No.: US 9,228,599 B2
(45) Date of Patent: Jan. 5, 2016

(54) HYDRAULIC CIRCUIT FOR CONSTRUCTION EQUIPMENT

(75) Inventors: Young-Jin Son, Changwon-si (KR); Jae-Whan Ok, Busan (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 308 days.

(21) Appl. No.: 13/819,761

(22) PCT Filed: Sep. 2, 2010

(86) PCT No.: PCT/KR2010/005968
§ 371 (c)(1),
(2), (4) Date: Feb. 28, 2013

(87) PCT Pub. No.: WO2012/030003
PCT Pub. Date: Mar. 8, 2012

(65) Prior Publication Data

US 2014/0083092 A1 Mar. 27, 2014

(51) Int. Cl.
*F15B 21/04* (2006.01)
*E02F 9/22* (2006.01)
(Continued)

(52) U.S. Cl.
CPC ..... *F15B 21/042* (2013.01); *E02F 9/226* (2013.01); *E02F 9/2228* (2013.01);
(Continued)

(58) Field of Classification Search
CPC ..... F15B 21/042; F15B 2211/611; F15B 2211/62; E02F 9/2292; E02F 9/226; E02F 9/2282; E02F 9/2285; E02F 9/2228
See application file for complete search history.

(56) References Cited

U.S. PATENT DOCUMENTS
6,823,672 B2 11/2004 Nakamura
6,826,457 B2 11/2004 Henson et al.
(Continued)

FOREIGN PATENT DOCUMENTS

EP 1953392 A1 8/2008
EP 2050970 A2 4/2009
(Continued)

OTHER PUBLICATIONS
Extended Search Report for European Patent Application No. 10856749.6 dated Nov. 5, 2014.
International Search Report (in Korean and English) and Written Opinion (in Korean) for PCT/KR2010/005968, mailed May 24, 2011; ISA/KR.
(Continued)

*Primary Examiner* — Edward Look
*Assistant Examiner* — Abiy Teka
(74) *Attorney, Agent, or Firm* — Harness, Dickey & Pierce, P.L.C.

(57) ABSTRACT

A hydraulic circuit for construction equipment is provided, which supplements hydraulic fluid of a hydraulic pump for a cooling fan and hydraulic fluid of a main hydraulic pump and uses the supplemented hydraulic fluid as a hydraulic source of a RCV in order to supply signal pressure to a control valve that controls the driving of a hydraulic actuator. The hydraulic circuit includes first to third hydraulic pumps, a first control valve installed in a flow path of the first flow path, a second control valve installed in a flow path of the second hydraulic flow path, a hydraulic motor connected to the third hydraulic pump, a cooling fan connected to the hydraulic motor, a first shuttle valve having an input portion connected to the first hydraulic pump and the third hydraulic pump, a second shuttle valve having an input portion connected to the second hydraulic pump and the third hydraulic pump, and a pilot pressure generation device installed in a pilot flow path connected to the output portions of the first and second shuttle valves and shifted to supply the hydraulic fluid having a relatively high pressure among the hydraulic fluids of the first to third hydraulic pumps to the first and second control valves as pilot signal pressure.

3 Claims, 2 Drawing Sheets

(51) Int. Cl.
*F15B 11/17* (2006.01)
*F15B 13/043* (2006.01)

(52) U.S. Cl.
CPC ..... *E02F 9/2282* (2013.01); *E02F 9/2285* (2013.01); *E02F 9/2292* (2013.01); *E02F 9/2296* (2013.01); *F15B 11/17* (2013.01); *F15B 13/043* (2013.01)

(56) References Cited

U.S. PATENT DOCUMENTS

| | | | | |
|---|---|---|---|---|
| 2003/0019681 | A1 | 1/2003 | Nakamura | |
| 2009/0094973 | A1* | 4/2009 | Cheong | 60/422 |

FOREIGN PATENT DOCUMENTS

| | | | | |
|---|---|---|---|---|
| JP | 09042204 | A | * | 2/1997 |
| JP | 11-132154 | A | | 5/1999 |
| JP | 11-218104 | A | | 8/1999 |
| JP | 2002-188177 | A | | 7/2002 |
| JP | 2006250219 | A | * | 9/2006 |
| JP | 2008-031752 | A | | 2/2008 |
| KR | 10-0640538 | B1 | | 10/2006 |
| KR | 10-2009-0068823 | A | | 6/2009 |

OTHER PUBLICATIONS

International Preliminary Report on Patentability (Chapter II of the Patent Cooperation Treaty) (in Korean) for PCT/KR2010/005968, dated Nov. 30, 2012; IPEA/KR.

* cited by examiner

PRIOR ART

HYDRAULIC CIRCUIT FOR CONSTRUCTION EQUIPMENT

TECHNICAL FIELD

The present invention relates to a hydraulic circuit for construction equipment. More particularly, the present invention relates to a hydraulic circuit for construction equipment, which can supplement hydraulic fluid of a hydraulic pump for a cooling fan and hydraulic fluid of a main hydraulic pump and use the supplemented hydraulic fluid as a hydraulic power source of a remote control valve (RCV) without separately installing a pilot pump which supplies signal pressure to a control valve (MCV) that controls driving of a hydraulic actuator.

BACKGROUND ART

One hydraulic circuit in the related art for a construction machine as illustrated in FIG. 1 includes first and second variable displacement hydraulic pumps 2 and 3 and third and fourth fixed displacement hydraulic pumps 4 and 15 connected to an engine 1; a first control valve 5 installed in a flow path of the first variable displacement hydraulic pump 2 and shifted to control hydraulic fluid supplied to hydraulic actuators that drive a boom, a bucket, and a traveling device in response to pilot signal pressure supplied from the fourth hydraulic pump 15; a second control valve 5*a* installed in a flow path of the second variable displacement hydraulic pump 3 and shifted to control hydraulic fluid supplied to hydraulic actuators that drive a swing device, an arm, and the traveling device in response to the pilot signal pressure supplied from the fourth hydraulic pump 15; a hydraulic motor 9 connected to the third fixed displacement hydraulic pump 4; a cooling fan 10 connected to the hydraulic motor 9 and rotated to discharge cooling wind to an oil cooler 11 to lower temperature of the hydraulic fluid that is drained to a hydraulic tank T through a return flow path 16; a temperature sensor 13 detecting the temperature of the hydraulic fluid in the hydraulic tank T; an electric relief valve 12 installed in a discharge flow path 17 of the third hydraulic pump 4 to control hydraulic pressure that drives the hydraulic motor 9 so as to variably control a rotating speed of the cooling fan 10; and a controller 14 controlling the hydraulic pressure that drives the hydraulic motor by varying the set pressure of the hydraulic motor 9 by varying set pressure of the electric relief valve 12 according to a detection signal from the temperature sensor 13.

Here, the detailed description and illustration of spools of the first and second control valves 5 and 5*a*, which are shifted to control the hydraulic fluid supplied from the first and second hydraulic pumps 2 and 3 to the hydraulic actuators in response to pilot signal pressure that is supplied from the fourth hydraulic pump 15 through shifting of a pilot pressure generation device 6, are omitted.

In the drawing, the reference numeral "8" denotes a relief valve installed in a pilot flow path 18 of the fourth hydraulic pump 15 to drain the hydraulic fluid to the hydraulic tank T when a load that exceeds pressure set in the fourth hydraulic pump 15 occurs.

Accordingly, by shifting the spools of the first and second control valves 5 and 5*a* through the shifting of the pilot pressure generation device 6, a working device such as a boom is driven by the hydraulic fluid that is supplied from the first hydraulic pump 2 to the hydraulic actuator, and the swing device is driven by the hydraulic fluid that is supplied from the second hydraulic pump 3 to the hydraulic actuator.

The hydraulic motor 9 is driven by the hydraulic fluid that is supplied from the third hydraulic pump 4 to the discharge flow path 17, and the cooling fan 10 is rotated by the driving of the hydraulic motor 9 to lower the temperature of the hydraulic fluid that returns to the hydraulic tank T through the oil cooler 11 installed in the return flow path 16.

The wind speed of the cooling wind that is discharged from the cooling fan 10 to the oil cooler 11 is in proportion to the rotating speed of the cooling fan 10, and if the rotating speed of the cooling fan 10 is increased, the load pressure of the hydraulic motor 9 is also increased.

In this case, the load pressure of the hydraulic motor 9 is controlled by the electric relief valve 12. That is, if the load pressure of the hydraulic fluid that is supplied from the third hydraulic pump 4 to the hydraulic motor 9 exceeds the set pressure of the electric relief valve 12, the hydraulic fluid having the excessive pressure is drained to the hydraulic tank T through the electric relief valve 12. Accordingly, the rotating speed of the cooling fan 10 can be controlled by the set pressure of the electric relief valve 12.

In the case of driving the working device such as the boom, the temperature of the hydraulic fluid, which returns from the hydraulic actuator having an increased temperature to the hydraulic tank T, is lowered by the cooling wind that is discharged through the cooling fan 10 while the hydraulic fluid passes through the oil cooler 11 installed in the return flow path 16.

That is, a detection signal, which corresponds to the temperature value of the hydraulic fluid in the hydraulic tank T that is detected by the temperature sensor 13, is input to the controller 14, and the controller 14 varies the set pressure by transmitting the control signal to the electric relief valve 12 so as to keep the set temperature of the hydraulic fluid.

For example, if the temperature of the hydraulic fluid in the hydraulic tank T exceeds the set temperature, the set pressure of the electric relief valve 12 is increased to heighten the hydraulic pressure that drives the hydraulic motor 9. Accordingly, the rotating speed of the cooling fan 10 is increased to increase the cooling capacity of the oil cooler 11.

In the hydraulic circuit in the related art for a construction machine illustrated in FIG. 1, the fourth fixed displacement hydraulic pump 15 (that is, the pilot pump) fixedly discharges a constant flow rate in accordance with the rotation of the engine 1. The hydraulic fluid that is discharged from the fourth hydraulic pump 15 is instantaneously used as the pilot signal pressure that shifts the spools of the first and second control valves 5 and 5*a* when the pilot pressure generation device 6 is shifted.

On the other hand, if the load that exceeds the set pressure occurs in the pilot flow path 18, the hydraulic fluid that is discharged from the fourth hydraulic pump 15 is drained to the hydraulic tank T through the relief valve 8, and this causes a power loss to occur.

That is, the lower loss is as follows.

Power loss=(set pressure of the relief valve 8)×(discharge flow rate that is drained to the hydraulic tank T)

Further, since the fourth hydraulic pump 15 is separately connected to the engine 1, the structure of the hydraulic circuit becomes complicated to cause the increase of the production cost.

Another hydraulic circuit in the related art for a construction machine as illustrated in FIG. 2 includes first and second variable displacement hydraulic pumps 2 and 3 and a third fixed displacement hydraulic pump 4 connected to an engine 1; a first control valve 5 installed in a flow path of the first variable displacement hydraulic pump 2 and shifted to control hydraulic fluid supplied to hydraulic actuators that drive a boom, a bucket, and a traveling device in response to pilot signal pressure supplied from the third hydraulic pump 4; a second control valve 5*a* installed in a flow path of the second variable displacement hydraulic pump 3 and shifted to control hydraulic fluid supplied to hydraulic actuators that drive a swing device, an arm, and the traveling device in response to the pilot signal pressure supplied from the third hydraulic pump 4; a hydraulic motor 9 connected to the third fixed displacement hydraulic pump 4; a cooling fan 10 connected to the hydraulic motor 9 and rotated to discharge cooling wind to an oil cooler 11 installed in a return flow path 16 of the first and second hydraulic pumps 2 and 3 to cool the hydraulic fluid that returns to a hydraulic tank T; a temperature sensor 13 detecting the temperature of the hydraulic fluid in the hydraulic tank T; an electric relief valve 12 installed in a discharge flow path 17 of the third hydraulic pump 4 to control hydraulic pressure that drives the hydraulic motor 9 so as to variably control a rotating speed of the cooling fan 10; a controller 14 controlling the hydraulic pressure that drives the hydraulic motor by varying the set pressure of the hydraulic motor 9 by varying set pressure of the electric relief valve 12 according to a detection signal from the temperature sensor 13; a pilot pressure generation device 6 installed in a pilot flow path 18 connected as a branch to a flow path of the third hydraulic pump 4 and shifted to supply pilot signal pressure to the first and second control valves 5 and 5*a*; a pressure reducing valve 7 installed in the pilot flow path 18 to supply the hydraulic fluid from the third hydraulic pump 4 to the pilot pressure generation device 6 by a set pressure of a valve spring 7*b*, and shifted to drain the hydraulic fluid to the hydraulic tank T if a load that exceeds the set pressure of the valve spring 7*b* occurs in the pilot pressure generation device 6; and a relief valve 8 installed in the pilot flow path 18 between the pressure reducing valve 7 and the pilot pressure generation device 6.

Since the pilot flow path 18 is connected as a branch to the discharge flow path 17 of the third hydraulic pump 4 for the cooling fan 10 and the pressure reduction valve 7 is installed in the pilot flow path 18, a separate fixed displacement hydraulic pump is not used, and thus a power loss can be minimized.

On the other hand, in the case of operating the pilot pressure generation device 6 that uses the hydraulic fluid from the third hydraulic pump 4 for the cooling fan 10 (see a curve "a" in FIG. 3), the flow rate of the hydraulic fluid of the third hydraulic pump 4 that is supplied to the hydraulic motor 9 is instantaneously reduced. Due to this, the revolution of the cooling fan 10 is abruptly reduced (for example, 1109 RPM→407.5 RPM) (see a curve "b" in FIG. 3), and thus the cooling effect is lowered.

Further, since the revolution of the cooling fan 10 is repeatedly changed between high RPM and low RPM depending on the operation of the pilot pressure generation device 6, noise (mechanical sound generated due to the irregular revolution of the cooling fan 10) occurs. Due to the irregular noise that occurs due to the change of the revolution of the cooling fan 10, an operator is unable to perform the operation smoothly.

DISCLOSURE

Technical Problem

One embodiment of the present invention is related to a hydraulic circuit for a construction machine, which does not require the use of a separate pilot pump for supplying signal pressure to a control valve (MCV) for controlling a hydraulic actuator and thus can prevent a power loss.

One embodiment of the present invention is related to a hydraulic circuit for a construction machine, which can prevent lowering of the revolution of a hydraulic motor for a cooling fan due to an operation of a remote control valve (RCV) and noise occurrence due to the revolution change of the cooling fan by supplementing hydraulic fluid of a hydraulic pump for the cooling fan and hydraulic fluid of a main hydraulic pump and using the supplemented hydraulic fluid as a hydraulic power source of the RCV.

Technical Solution

In accordance with an aspect of the present invention, there is provided a hydraulic circuit for a construction machine, which includes first and second variable displacement hydraulic pumps and a third fixed displacement hydraulic pump connected to an engine; a first control valve installed in a flow path of the first hydraulic pump and shifted to control hydraulic fluid supplied to respective hydraulic actuators that drive working devices and a traveling device; a second control valve installed in a flow path of the second hydraulic pump and shifted to control hydraulic fluid supplied to respective hydraulic actuators that drive a swing device, a working device, and the traveling device; a hydraulic motor connected to the third hydraulic pump; a cooling fan connected to the hydraulic motor to discharge cooling wind to an oil cooler installed in a return flow path of the first and second hydraulic pumps so as to cool the hydraulic fluid returning to a hydraulic tank; a temperature sensor detecting a temperature of the hydraulic fluid in the hydraulic tank; an electric relief valve installed in a discharge flow path of the third hydraulic pump to control a set pressure of the hydraulic fluid supplied to the hydraulic motor so as to variably control a rotating speed of the cooling fan; a controller controlling hydraulic pressure that drives the hydraulic motor by varying the set pressure of the electric relief valve in accordance with a detection signal from the temperature sensor; a first shuttle valve having one input portion connected to the flow path of the first hydraulic pump and the other input portion connected to the discharge flow path of the third hydraulic pump, and outputting high-pressure hydraulic fluid of the hydraulic fluids of the first hydraulic pump and the third hydraulic pump; a second shuttle valve having one input portion connected to the flow path of the second hydraulic pump and the other input portion connected to the discharge flow path of the third hydraulic pump, and outputting high-pressure hydraulic fluid of the hydraulic fluids of the second hydraulic pump and the third hydraulic pump; and a pilot pressure generation device installed in a pilot flow path connected to the output portions of the first and second shuttle valves and shifted to supply the hydraulic fluid having a relatively high pressure among the hydraulic fluids of the first to third hydraulic pumps to the first and second control valves as pilot signal pressure.

The hydraulic circuit for a construction machine according to the aspect of the present invention may further include a pressure reducing valve installed in the pilot flow path, and shifted to supply the hydraulic fluid having a relatively high pressure among the hydraulic fluids of the first to third hydraulic pumps to the pilot pressure generation device as the pilot signal pressure by a set pressure of a valve spring , and shifted to drain the hydraulic fluid to the hydraulic tank when a load that exceeds the set pressure of the valve spring occurs in the pilot pressure generation device.

The hydraulic circuit for a construction machine according to the aspect of the present invention may further includes a relief valve installed in the pilot flow path provided between the pressure reducing valve and the pilot pressure generation device.

Advantageous Effect

The hydraulic circuit for a construction machine as configured above according to the aspects of the present invention has the following advantages.

Since the use of a separate pilot pump for supplying signal pressure to the control valve (MCV) for controlling the hydraulic actuator such as the boom cylinder is unnecessary, a power loss can be prevented, and the production cost can be reduced.

Since the hydraulic fluid of the hydraulic pump for the cooling fan and the hydraulic fluid of the main hydraulic pump can be supplemented and used as the hydraulic power source of the RCV during the operation of the RCV, the cooling efficiency can be prevented from being lowered due to the lowering of the revolution of the hydraulic motor for the cooling fan during the operation of the RCV, and the operator's operation interference due to the noise caused by the revolution change of the cooling fan can be prevented.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF REFERENCE NUMERALS IN THE DRAWING

Figure 1:
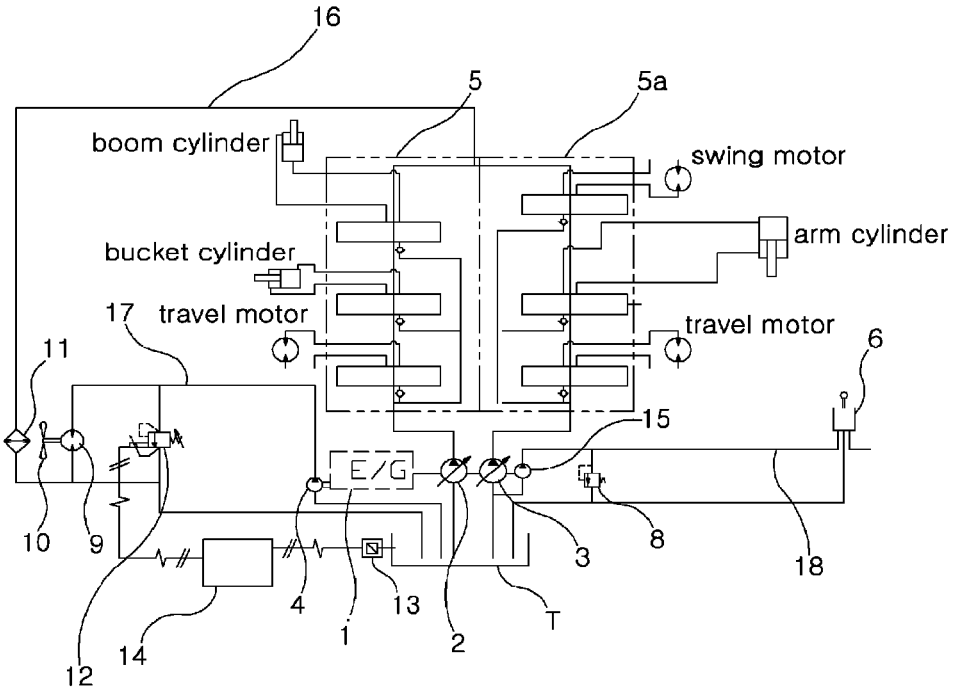
FIG. 1 is a diagram of one hydraulic circuit in the related art for construction equipment.
Figure 2:
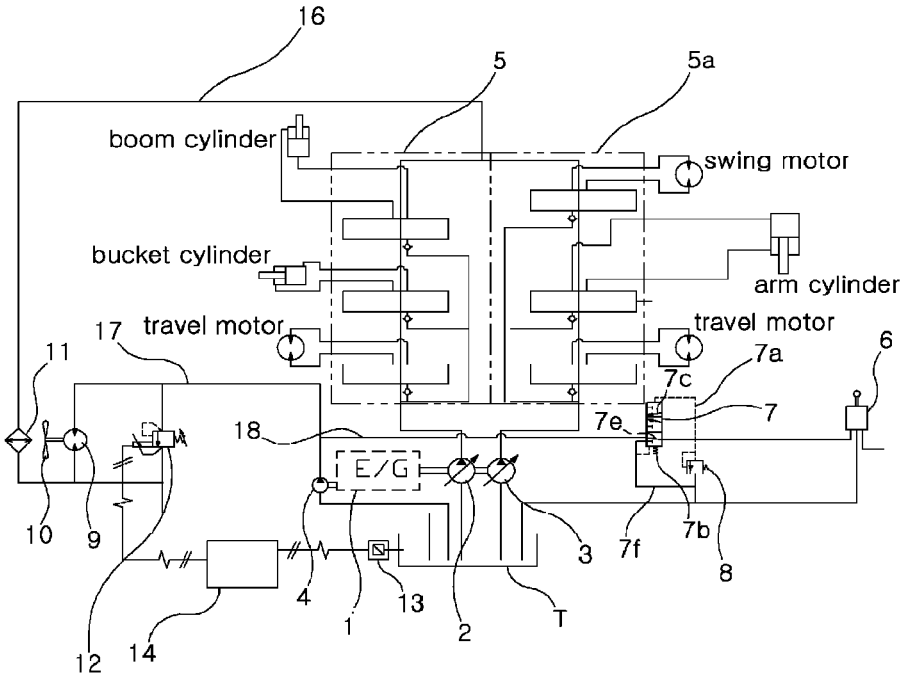
PRIOR ART Fig.2
FIG. 2 is a diagram of another hydraulic circuit in the related art for construction equipment.
Figure 3:
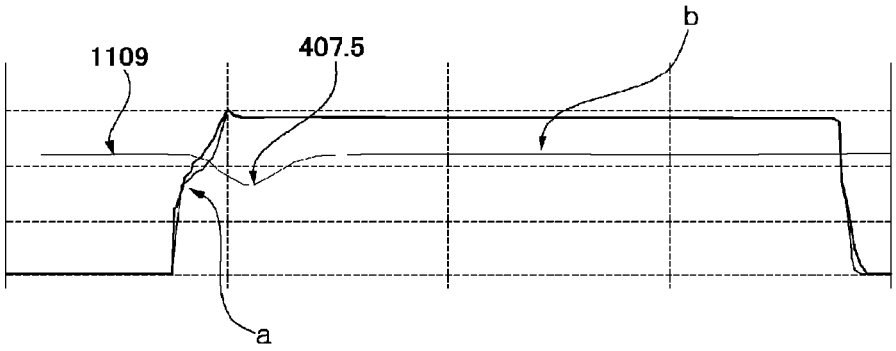
FIG. 3 is a waveform diagram of revolution of a cooling fan in the related art.

1: engine
2: first variable displacement hydraulic pump
3: second variable displacement hydraulic pump
4: third variable displacement hydraulic pump
5: first control valve (MCV)
5*a*: second control valve (MCV)
6: pilot pressure generation device (RCV)
7: pressure reducing valve
8: relief valve
9: hydraulic motor
10: cooling fan
11: oil cooler
12: electric relief valve
13: temperature sensor
14: controller
16: return flow path
17: discharge flow path
18: pilot flow path
20: first shuttle valve
21: second shuttle valve

BEST MODE

Now, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 4:
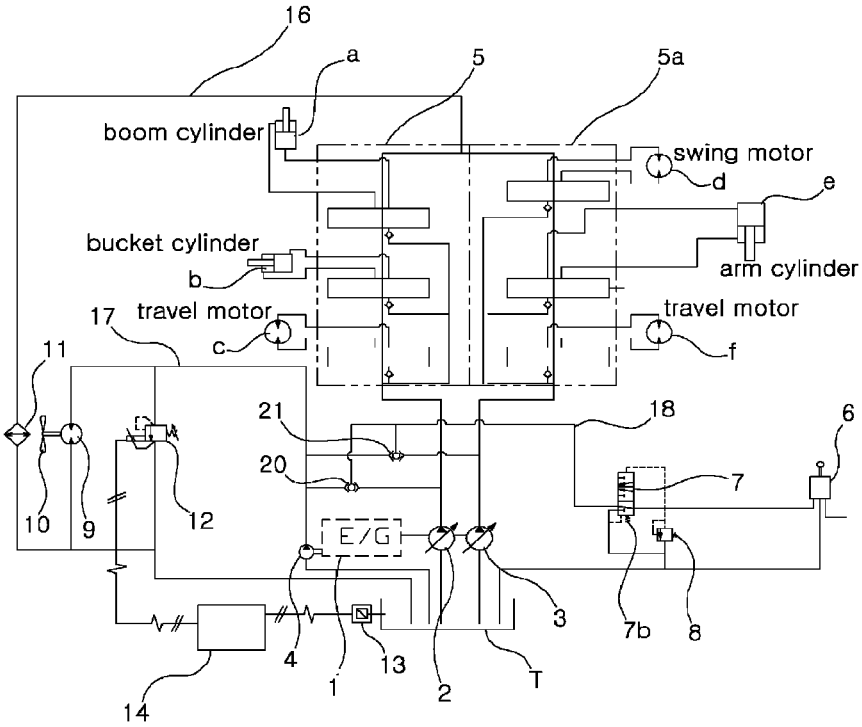
PRIOR ART Fig.4
FIG. 4 is a diagram of a hydraulic circuit for construction equipment according to an embodiment of the present invention.

A hydraulic circuit for a construction machine according to an embodiment of the present invention, as illustrated in FIG. 4, includes first and second variable displacement hydraulic pumps 2 and 3 and a third fixed displacement hydraulic pump 4 connected to an engine 1; a first control valve (MCV) 5 installed in a flow path of the first hydraulic pump 2 and shifted to control hydraulic fluid supplied to respective hydraulic actuators a, b, and c that drive a boom, a bucket, and a traveling device; a second control valve (MCV) 5*a* installed in a flow path of the second hydraulic pump 3 and shifted to control hydraulic fluid supplied to respective hydraulic actuators d, e, and f that drive a swing device, an arm, and the traveling device; a hydraulic motor 9 connected to the third hydraulic pump 4; a cooling fan 10 connected to the hydraulic motor 9 to discharge cooling wind to an oil cooler 11 installed in a return flow path 16 of the first and second hydraulic pumps 2 and 3 so as to cool the hydraulic fluid returning to a hydraulic tank; a temperature sensor 13 detecting a temperature of the hydraulic fluid in the hydraulic tank T; an electric relief valve 12 installed in a discharge flow path 17 of the third hydraulic pump 4 to control a set pressure of the hydraulic fluid supplied to the hydraulic motor 9 so as to variably control a rotating speed of the cooling fan 10; a controller 14 controlling hydraulic pressure that drives the hydraulic motor 9 by varying the set pressure of the electric relief valve 12 in accordance with a detection signal from the temperature sensor 13; a first shuttle valve 20 having one input portion connected to the flow path of the first hydraulic pump 2 and the other input portion connected to the discharge flow path 17 of the third hydraulic pump 4, and outputting high-pressure hydraulic fluid of the hydraulic fluids of the first hydraulic pump 2 and the third hydraulic pump 4; a second shuttle valve 21 having one input portion connected to the flow path of the second hydraulic pump 3 and the other input portion connected to the discharge flow path 17 of the third hydraulic pump 4, and outputting high-pressure hydraulic fluid of the hydraulic fluids of the second hydraulic pump 3 and the third hydraulic pump 4; and a pilot pressure generation device (RCV) 6 installed in a pilot flow path 18 connected to the output portions of the first and second shuttle valves 20 and 21 and shifted to supply the hydraulic fluid having a relatively high pressure among the hydraulic fluids of the first to third hydraulic pumps 2, 3, and 4 to the first and second control valves 5 and 5*a* as pilot signal pressure.

The hydraulic circuit for a construction machine according to an embodiment of the present invention may further include a pressure reducing valve 7 installed in the pilot flow path 18, and shifted to supply the hydraulic fluid having a relatively high pressure among the hydraulic fluids of the first to third hydraulic pumps 2, 3, and 4 to the pilot pressure generation device 6 as the pilot signal pressure by a set pressure of a valve spring 7*b*, and shifted to drain the hydraulic fluid to the hydraulic tank T when a load that exceeds the set pressure of the valve spring 7*b* occurs in the pilot pressure generation device 6.

The hydraulic circuit for a construction machine according to an embodiment of the present invention may further includes a relief valve 8 installed in the pilot flow path 18 provided between the pressure reducing valve 7 and the pilot pressure generation device 6.

Hereinafter, the operation of the hydraulic circuit for construction equipment according to an embodiment of the present invention will be described in detail with reference to the accompanying drawings.

As shown in FIG. 4, as the spools of the first and second control valves 5 and 5*a* are driven by the operation of the pilot pressure generation device 6, the hydraulic actuators (for example, a boom cylinder a, a bucket cylinder b, and a traveling motor c) are driven by the hydraulic fluid that is discharged from the first hydraulic pump 2, and the hydraulic actuators (for example, a swing motor d, an arm cylinder e, and a traveling motor f) are driven by the hydraulic fluid that is discharged from the second hydraulic pump 3.

On the other hand, the hydraulic motor 9 is driven by the hydraulic fluid that is supplied from the third hydraulic pump 4 through the discharge flow path 17, and the cooling fan 10 is rotated by the driving of the hydraulic motor 9 to discharge cooling wind to the oil cooler 11. Through this, the temperature of the hydraulic fluid that returns from the hydraulic actuators to the hydraulic tank T through the oil cooler 11 installed in the return flow path 16 installed in the return flow path 16 can be lowered.

At this time, the hydraulic fluid that is discharged from the first and second variable displacement hydraulic pumps 2 and 3 keeps pressure that is relatively higher than the pressure of the hydraulic fluid that is discharged from the third fixed displacement hydraulic pump 4. Due to this, the hydraulic fluid discharged from the first and second hydraulic pumps 2 and 3 is output through the output portions of the first and second shuttle valves 20 and 21, passes through the pilot flow path 18 with the pressure set by the valve spring 7*b*, and is supplied to the pilot pressure generation device 6 through the pressure reducing valve 7.

Accordingly, the hydraulic fluid that is discharged from the third hydraulic pump 4 is supplemented by the hydraulic fluid from the first and second hydraulic pumps 2 and 3, and is supplied to the pilot pressure generation device 6 through the pilot flow path 18 as the pilot signal pressure.

Through this, when the spools of the first and second control valves 5 and 5*a* are operated through the operation of the pilot pressure generation device 6 in order to drive the working devices, such as the boom and the arm, and the traveling device, no interference occurs. Further, since the hydraulic fluid of the third hydraulic pump 4 that supplies the hydraulic fluid to the hydraulic motor 9 to drive the cooling fan 10 is supplemented by the hydraulic fluid of the first hydraulic pump 2 or the second hydraulic pump 3, the revolution of the cooling fan 10 can be prevented from being changed (by the operation of the pilot pressure generation device 6, the flow rate of the hydraulic fluid that is supplied from the third hydraulic pump 4 to the hydraulic motor 9 can be prevented from being reduced).

On the other hand, in the case where the pressure of the hydraulic fluid of the first and second hydraulic pumps 2 and 3 is relatively lower than the pressure of the hydraulic fluid of the third hydraulic pump 4, the moment when the pilot pressure generation device 6 is operated always becomes the time point when the working devices, such as the boom and the arm, start their driving. Accordingly, high pressure is generated at an initial stage when the pilot pressure generation device 6 is operated, and thereafter, the hydraulic pressure becomes lowered.

That is, in the case where the pilot pressure generation device 6 is not operated, the hydraulic fluid in the pilot flow path 18 returns to the hydraulic tank T through the pilot pressure generation device 6 in a neutral state, and thus the pilot flow path 18 is kept vacant. By contrast, in the case where the pilot pressure generation device 6 is operated, the hydraulic fluid is supplemented only for a short time when the pilot flow path 18 is filled with the hydraulic fluid, and thereafter, only the hydraulic fluid that corresponds to the operation amount of the pilot pressure generation device 6 is required.

Accordingly, at a moment when the initial high pressure is generated to operate the pilot pressure generation device 6, the hydraulic fluid of the first and second hydraulic pumps 2 and 3 is supplemented through the pilot flow path 18, and then if the hydraulic fluid pressure of the third hydraulic pump 4 is heightened, only the hydraulic fluid that corresponds to the operation of the pilot pressure generation device 6 is required.

Through this, a loss of the flow rate to drive the hydraulic motor 9 is decreased during the operation of the pilot pressure generation device 6, and thus the revolution of the hydraulic motor 9 is not changed. Accordingly, the cooling fan 10 is rotated constantly, and thus the cooling efficiency can be prevented from being lowered. Further, the noise change due to the revolution change of the cooling fan 10 does not occur, and thus the operator can conveniently perform the work.

Further, if the revolution of the engine 1 is low or the operation of the pilot pressure generation device 6 is performed slowly, the time required for supplying the hydraulic fluid from the third hydraulic pump 4 to the discharge flow path 17 and the pilot flow path 18 becomes lengthened.

Through this, even in the case where the pressure of the hydraulic fluid of the third hydraulic pump 4 is higher than the pressure of the hydraulic fluid of the first and second hydraulic pumps 2 and 3 and the high pressure is not generated in the first and second hydraulic pumps 2 and 3 during the initial operation of the pilot pressure generation device 6, the hydraulic fluid of the third hydraulic pump 4 is not rapidly reduced. Accordingly, the revolution of the cooling fan 10 is not changed.

INDUSTRIAL APPLICABILITY

As apparent from the above description, according to the hydraulic circuit for a construction machine according to the embodiment of the present invention, the hydraulic fluid of the fixed displacement hydraulic pump that drives the hydraulic motor for the cooling fan is used as the pilot signal pressure that is supplied to the pilot pressure generation device (RCV) so as to control the driving of the hydraulic actuators, and the hydraulic fluid of the variable displacement main hydraulic pump is supplemented. Through this, the flow rate of the hydraulic fluid that is supplied to the hydraulic motor for the cooling fan is not reduced during the operation of the pilot pressure generation device, and thus the cooling efficiency is improved. Further, the revolution of the cooling fan is kept constant, and thus the noise occurrence due to the irregular change of the revolution can be prevented.

The invention claimed is:

1. A hydraulic circuit for construction equipment comprising:

first and second variable displacement hydraulic pumps and a third fixed displacement hydraulic pump connected to an engine;

a first control valve installed in a flow path of the first hydraulic pump and shifted to control hydraulic fluid supplied to respective hydraulic actuators that drive working devices and a traveling device;

a second control valve installed in a flow path of the second hydraulic pump and shifted to control hydraulic fluid supplied to respective hydraulic actuators that drive a swing device, a working device, and the traveling device;

a hydraulic motor connected to the third hydraulic pump;

a cooling fan connected to the hydraulic motor to discharge cooling wind to an oil cooler installed in a return flow path of the first and second hydraulic pumps so as to cool the hydraulic fluid returning to a hydraulic tank;

a temperature sensor detecting a temperature of the hydraulic fluid in the hydraulic tank;

an electric relief valve installed in a discharge flow path of the third hydraulic pump to control a set pressure of the hydraulic fluid supplied to the hydraulic motor so as to variably control a rotating speed of the cooling fan;

a controller controlling hydraulic pressure that drives the hydraulic motor by varying the set pressure of the electric relief valve in accordance with a detection signal from the temperature sensor;

a first shuttle valve installed upstream of the first control valve, the first shuttle valve including one input portion connected to the flow path of the first variable displacement hydraulic pump and the other input portion connected to the discharge flow path of the third fixed hydraulic pump, and outputting high-pressure hydraulic fluid of the hydraulic fluids of the first hydraulic pump and the third hydraulic pump;

a second shuttle valve installed upstream of the second control valve, the second shuttle valve including one input portion connected to the flow path of the second variable displacement hydraulic pump and the other input portion connected to the discharge flow path of the third fixed hydraulic pump, and outputting high-pressure hydraulic fluid of the hydraulic fluids of the second variable displacement hydraulic pump and the third fixed hydraulic pump;

a pilot pressure generation device installed in a pilot flow path connected to the output portions of the first and second shuttle valves and shifted to supply the hydraulic fluid having a relatively high pressure among the hydraulic fluids of the first to third hydraulic pumps to the first and second control valves as pilot signal pressure; and a pressure reducing valve installed in the pilot flow path, and shifted to supply the hydraulic fluid having a relatively high pressure among the hydraulic fluids of the first to third hydraulic pumps to the pilot pressure generation device as the pilot signal pressure by a set pressure of a valve spring, and shifted to drain the hydraulic fluid to the hydraulic tank when a load that exceeds the set pressure of the valve spring occurs in the pilot pressure generation device.

2. The hydraulic circuit for construction equipment according to claim 1, further comprising a relief valve installed in the pilot flow path provided between the pressure reducing valve and the pilot pressure generation device.

3. A hydraulic circuit for construction equipment comprising:

first and second variable displacement hydraulic pumps, and a third fixed displacement hydraulic pump connected to an engine;

a first control valve in a flow path of the first hydraulic pump and configured to control hydraulic fluid supplied to respective hydraulic actuators that drive working devices and a traveling device;

a second control valve in a flow path of the second hydraulic pump and configured to control hydraulic fluid supplied to respective hydraulic actuators that drive a swing device, a working device, and the traveling device;

a hydraulic motor connected to the third hydraulic pump;

a cooling fan connected to the hydraulic motor to discharge cooling wind to an oil cooler installed in a return flow path of the first and second hydraulic pumps so as to cool the hydraulic fluid returning to a hydraulic tank;

a temperature sensor detecting a temperature of the hydraulic fluid in the hydraulic tank;

an electric relief valve installed in a discharge flow path of the third hydraulic pump to control a set pressure of the hydraulic fluid supplied to the hydraulic motor so as to variably control a rotating speed of the cooling fan;

a controller controlling hydraulic pressure that drives the hydraulic motor by varying the set pressure of the electric relief valve in accordance with a detection signal from the temperature sensor;

a first shuttle valve arranged upstream of the first control valve, the first shuttle valve configured to receive hydraulic fluid from the first variable displacement hydraulic pump and the third fixed hydraulic pump;

a second shuttle valve arranged upstream of the second control valve, the second shuttle valve configured to receive hydraulic fluid from the second variable displacement hydraulic pump and the third fixed hydraulic pump;

a pilot pressure generation device arranged in a pilot flow path connected to outputs of each of the first and second shuttle valves, and configured to supply hydraulic fluid having a relatively high pressure among hydraulic fluid of the first to third hydraulic pumps to the first and second control valves as pilot signal pressure; and a pressure reducing valve arranged in the pilot flow path, and configured to supply hydraulic fluid having a relatively high pressure among hydraulic fluids of the first to third hydraulic pumps to the pilot pressure generation device as the pilot signal pressure by a set pressure of a valve spring, and shifted to drain the hydraulic fluid to the hydraulic tank when a load that exceeds the set pressure of the valve spring occurs in the pilot pressure generation device;

wherein hydraulic flow rate to the hydraulic motor remains constant throughout operation of the pilot pressure generation device to maintain rotation of the cooling fan at a constant speed.

* * * * *